United States Patent [19]

Wilder et al.

[11] 4,058,064

[45] Nov. 15, 1977

[54] POWER AND FREE CONVEYOR SYSTEM WITH SPACED APART ACTUATION AND ENGAGEMENT MEANS

[75] Inventors: Richard J. Wilder, Sterling Heights; Ivan Wurfel, Warren, both of Mich.

[73] Assignee: American Chain & Cable Company, Inc., Bridgeport, Conn.

[21] Appl. No.: 761,412

[22] Filed: Jan. 21, 1977

Related U.S. Application Data

[63] Continuation of Ser. No. 593,650, July 7, 1975, abandoned.

[51] Int. Cl.[2] ..... B65C 17/42; B61B 10/02

[52] U.S. Cl. ..... 104/172 S; 104/172 C

[58] Field of Search ..... 104/172 S, 172 C, 172 R

[56] References Cited

U.S. PATENT DOCUMENTS

| | | | |
|---|---|---|---|
| 3,044,416 | 7/1962 | Reibel et al. | 104/172 S |
| 3,070,037 | 12/1962 | Burrows | 104/172 S |
| 3,074,357 | 1/1963 | Orwin | 104/172 S |
| 3,076,418 | 2/1963 | Orwin | 104/172 S |
| 3,354,834 | 11/1967 | Orwin | 104/172 S |
| 3,818,840 | 6/1974 | Dehne | 104/172 S |

FOREIGN PATENT DOCUMENTS

| | | | |
|---|---|---|---|
| 801,898 | 9/1958 | United Kingdom | 104/172 S |

*Primary Examiner*—Robert J. Spar
*Assistant Examiner*—Carl Rowold
*Attorney, Agent, or Firm*—Barnes, Kisselle, Raisch & Choate

[57] ABSTRACT

A conveyor system comprising a conveyor track, a conveyor movable along said track, a free track and a plurality of carriers movable along the free track. The conveyor has longitudinally spaced pusher and holdback dogs mounted thereon. Each carrier comprises spaced trolleys and a tie bar interconnecting the trolleys. A trailing trolley has a pusher movably mounted thereon for movement into and out of the path of the pusher and holdback dogs. A bumper is mounted on the carrier at the front end thereof so that it engages a preceding carrier or an obstacle. The bumper and the retractable pusher are interconnected such that upon engagement of the bumper with the preceding carrier or obstacle the pusher is retracted out of the path of the pusher dog.

16 Claims, 12 Drawing Figures

FIG. 5
FIG. 6
FIG. 7
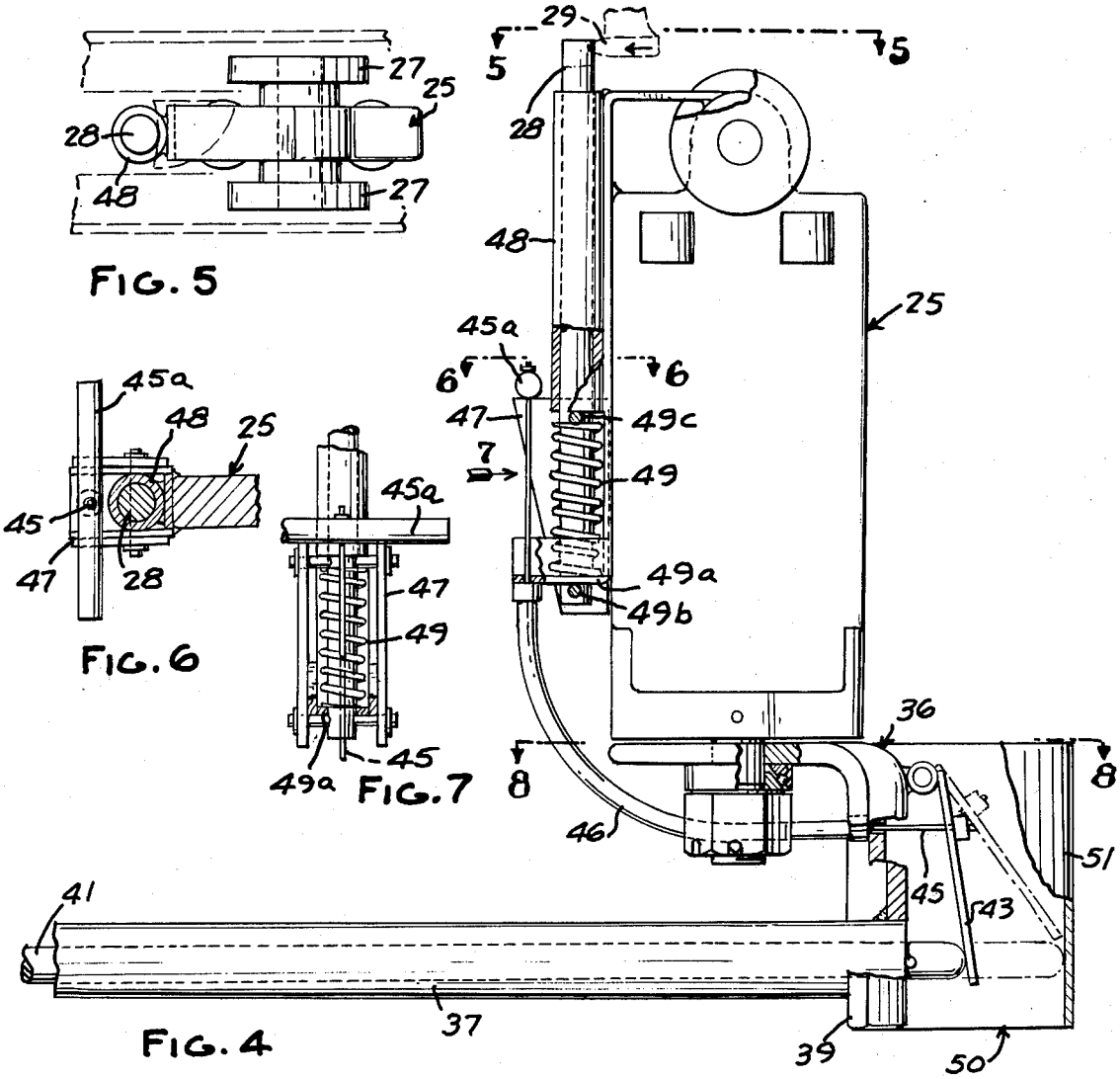
FIG. 4
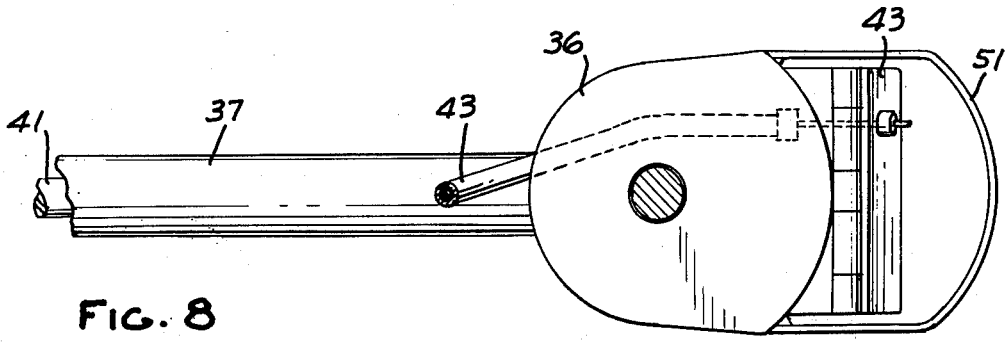
FIG. 8

POWER AND FREE CONVEYOR SYSTEM WITH SPACED APART ACTUATION AND ENGAGEMENT MEANS

This is a continuation of application Ser. No. 593,650, filed July 7, 1975 now abandoned.

This invention relates to conveyor systems and particularly to power and free conveyor systems.

BACKGROUND OF THE INVENTION

In power and free conveyor systems, it has long been known that the carriers which are movable along a carrier or free track can be disconnected from driving engagement with the conveyor that is movable on the conveyor track by various means. Where the pusher dog is on the carriers and the pusher is on the conveyor, means may be provided on the carrier such that when the carrier engages an obstacle or a preceding carrier, the pusher dog on the carrier is moved out of the path of the pusher on the conveyor. Where the holdback and pusher dogs are pivoted about longitudinally extending axes on the conveyor and the pusher is on the carrier, the problem of accumulation has been approached by providing means long the track for deflecting the pusher and holdback dogs out of the path of the pusher on the carrier. It has also been heretofore suggested that a cam on the carrier be provided for moving the dogs on the conveyor so that they do not engage the pusher on the carrier. However, where the carrier comprises a plurality of trolleys and the pusher is on a trailing trolley, such an arrangement is not suitable.

Accordingly, among the objects of the invention are to provide a system wherein a carrier having a plurality of trolleys with the pusher on a trailing trolley be readily disconnectable from driving engagement with the conveyor upon engagement with an obstacle or a preceding carrier; which system is dependable and which will function effectively upon straight or curved track sections.

SUMMARY OF THE INVENTION

In accordance with the invention, the conveyor system comprises a conveyor track, a conveyor movable along said track, a free track, a plurality of carriers movable along the free track. The conveyor has longitudinally spaced pusher dogs mounted thereon. Each carrier comprises spaced trolleys and means interconnecting the trolleys. A trailing trolley has said pusher movably mounted thereon for movement into and out of the path of the pusher dogs. A bumper is mounted on said carrier at the front end thereof and is adapted to engage a preceding carrier or an obstacle, and means interconnect the bumper and the retractable pusher such that upon engagement of the bumper with the preceding carrier or obstacle the pusher is retracted out of the path of the pusher and holdback dogs.

DESCRIPTION OF THE DRAWINGS

FIG. 4 is a fragmentary part sectional view on an enlarged scale of a portion of the system shown in FIG. 1.

FIG. 5 is a fragmentary view taken along the line 5—5 in FIG. 4.

FIG. 6 is a fragmentary sectional view taken along the line 6—6 in FIG. 4.

FIG. 7 is a view taken in the direction of the arrow 7 in FIG. 4.

FIG. 8 is a fragmentary sectional view taken along the line 8—8 in FIG. 4.

DESCRIPTION

Figures 1, 2, 3:
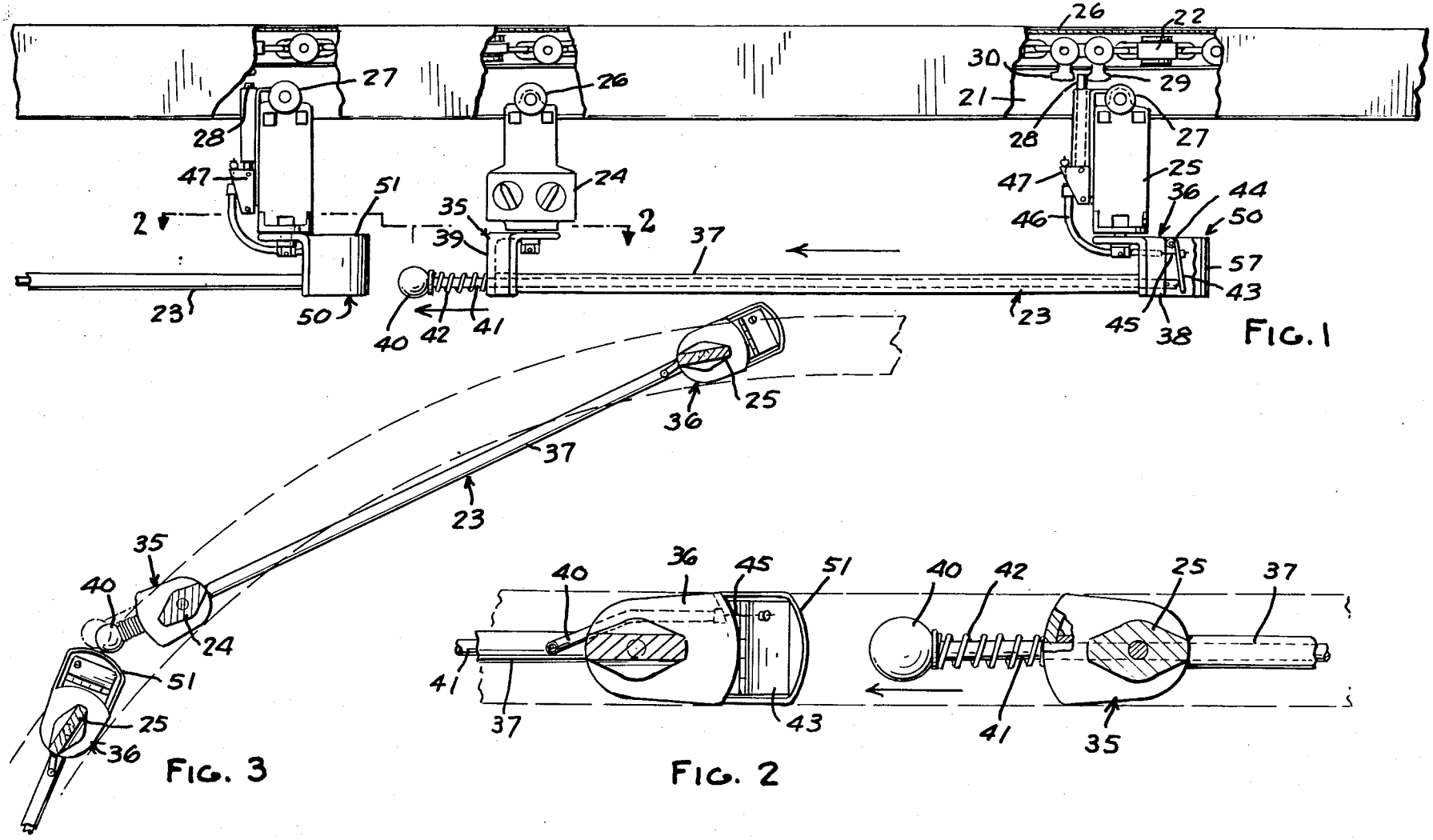
FIG. 1 is a fragmentary part sectional side elevational view of a conveyor system embodying the invention.
FIG. 2 is a fragmentary sectional view on an enlarged scale taken along the line 2—2 in FIG. 1.
FIG. 3 is a fragmentary plan view showing the parts in a different operative position.
Figure 9:
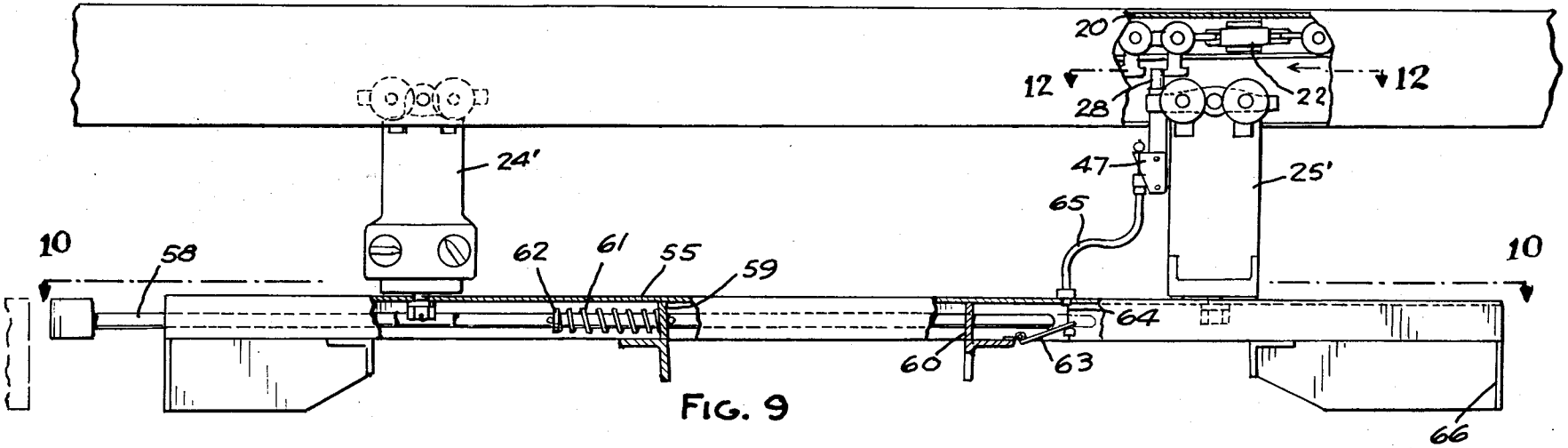
FIG. 9 is a fragmentary part sectional elevational view of a modified form of the invention.
Figure 10:
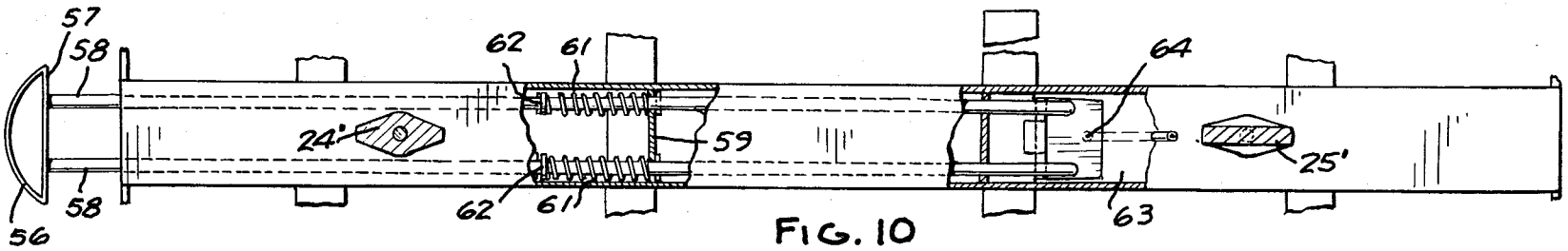
FIG. 10 is a fragmentary sectional view taken along the line 10—10 in FIG. 9.
Figure 12:
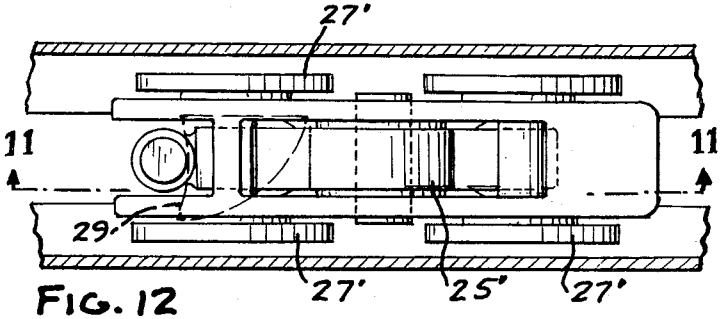
FIG. 12 is a fragmentary sectional view on an enlarged scale taken along the line 12—12 in FIG. 9.
Figure 11:
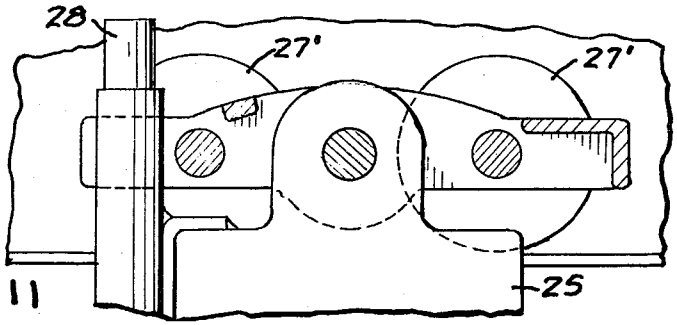
FIG. 11 is a fragmentary part sectional view of a portion of the system shown in FIG. 9 on an enlarged scale.

Referring to FIG. 1, the invention relates to a power and free conveyor system comprising a power or conveyor track 20 and a free or carrier track 21, herein shown as two tubular sections, one mounted within the other. A chain conveyor 22 having rollers thereon is movable along the carrier track 20. A plurality of carriers 23 are movable along the carrier track 21.

Each carrier 23 comprises a leading trolley 24 and a trailing trolley 25, each of which has spaced rollers 26, 27 that engage the carrier track 21. A pusher 28 is provided on the trailing trolley 25 and is adapted to be engaged by a pusher dog 29 on the conveyor 22 to move the carrier along the carrier track. A holdback dog 30 is provided in advance of each pusher dog 29 and serves the function of controlling the movement of the carrier since the pusher 28 is normally positioned between the holdback dog 30 and pusher dog 29. A plurality of holdback and pusher dogs 30, 29 are provided at longitudinally spaced points along the conveyor 22 and are pivoted about longitudinal axes extending in the path of movement of the conveyor, in accordance with conventional practice. If a carrier is stopped in any position, as the holdback dog 30 approaches, a cam surface thereon causes the holdback dog to be deflected by the pusher 28 bringing the pusher dog 29 into engagement with the pusher 28 so that the carrier is then advanced along the track by the conveyor.

Such a construction of power and free conveyor systems is old and well known, for example, in U.S. Pat. Nos. 3,060,886, issued Oct. 30, 1962, and 3,094,943, issued June 25, 1963.

In accordance with the invention, front and rear brackets 35, 36 are pivoted about vertical axes to the lower ends of the leading and trailing trolleys 24, 25, respectively. A tie bar 37 in the form of a tube is fixed to downwardly extending flanges 38, 39, respectively, of the brackets 35, 36. A bumper 40 in the form of a sphere is fixed to the front end of a rod 41 that extends within tube 37 and is yieldingly urged forwardly by a spring 42 interposed between the bumper 40 and flange 38 of bracket 35.

The rear end of rod 41 contacts a cam plate 43 that is pivoted about a horizontal axis by a pin 44 so that the cam plate extends downwardly and rearwardly in its normal position. A core wire 45 has one end fastened to the cam plate and the other end extends through a flexible housing 46 and is fastened to a bar 45*a* which engages a bracket 47 fixed to the pusher 28. The pusher 28 is mounted for vertical reciprocating movement in a tubular bracket 48 and is yieldingly urged upwardly by a spring 49 interposed between a fixed plate 49*a* held in a position by pin 49*b* and a pin 49*c* extending through the pusher 28.

A deflector 50 provides an arcuate surface 51 that has its center of radius extending vertically not only to protect the plate 43 but to serve as a fixed point of contact with the pumper 40.

In operation, the carriers are moved along by entrapment of the pusher 28 between pusher and holdback dogs 29, 30. When the carrier encounters an obstacle or a preceding carrier, the bumper 40 and rod 41 move rearwardly pivoting the cam plate 43 and drawing the pusher 28 out of engagement with the pusher dog 29, thereby stopping the carrier. When the obstacle is removed, the springs 41, 49 permit the return of the plunger to its initial position for engagement with the pusher dog 29.

Since the brackets 38, 39 are pivoted about vertical axes to the trolley bodies, the carrier can readily move about horizontal curves in the track as shown in FIG. 3.

In the form of the invention shown in FIGS. 9–12, the trolleys are substantially identical to the previous form of the invention except that each trolley includes two pairs of rollers 26', 27'. In this form, the tie bar 55 comprises an inverted U-shaped cross section and the bumper 56 comprises an arcuate plate having a vertical center of curvature. Bumper 56 is mounted on a cross plate 57 which is fastened to a pair of rods 58 that are reciprocably mounted in openings in cross members 59, 60 and are yieldingly urged forwardly by springs 61 interposed between cross members 59 and washers 62 on the rods.

In this form of the invention, the cam plate 63 is pivoted at its lower end and normally extends upwardly and forwardly. Core wire 64 is connected to the plate and extends through a flexible housing 65 to the bracket 47 as in the previous form of the invention.

In addition, in this form of the invention, the trolley has longitudinally spaced wheels as contrasted to a single wheel as shown in the previous form.

The operation of the device is substantially the same as in the previous form of the invention.

A fixed vertically extending deflector 66 is provided at the rear end of the tie bar which projects beyond the rear trolley 25'.

We claim:

1. In a conveyor system, the combination comprising
a conveyor track,
a conveyor movable along said track,
a free track,
a plurality of carriers movable along the free track,
said conveyor having longitudinally spaced pusher and holdback dogs mounted thereon,
each said carrier comprising spaced apart wheeled trolleys and means interconnecting said trolleys for pivotal movement about vertical axes through said trolleys,
a trailing trolley having a pusher movably mounted thereon for movement into and out of the path of the pusher and holdback dogs,
a bumper,
said bumper being mounted for movement on the leading trolley of said carrier and that engages and is moved by a preceding carrier or an obstacle,
and means interconnecting said bumper and said retractable pusher and operating upon engagement of the bumper with the preceding carrier or obstacle to displace said bumper and thereby move said pusher out of the path of said pusher and holdback dogs.

2. The combination set forth in claim 1 wherein said means interconnecting said trolleys comprise a tie bar pivoted about vertical axes to each of said trolleys,
said means interconnecting said bumper and said pusher including means extending along said tie bar.

3. The combination set forth in claim 1 wherein one of said bumper and the trailing end of said carrier is curved about a vertical axis.

4. In a conveyor system, the combination comprising
a conveyor track,
a conveyor movable along said track,
a free track,
a plurality of carriers movable along the free track,
said conveyor having longitudinally spaced pusher and holdback dogs mounted thereon and pivoted about horizontal longitudinally extending axes,
each said carrier comprising spaced apart wheeled trolleys and means interconnecting said trolleys for pivotal movement about vertical axes through said trolleys,
a trailing trolley,
a pusher,
means for movably mounting said pusher on said trolley vertical for movement into and out of the path of the pusher and holdback dogs,
a bumper,
said bumper being mounted for movement on a leading trolley of said carrier at the front end thereof and that engages and is moved by a preceding carrier or an obstacle,
and means interconnecting said bumper and said retractable pusher and operating upon engagement of the bumper with the preceding carrier or obstacle to displace said bumper and thereby move said pusher out of the path of said pusher and holdback dogs.

5. The combination set forth in claim 4 wherein said means interconnecting said trolleys comprise a tie bar pivoted about vertical axes to said trolleys,
said means interconnecting said bumper and said pusher including means extending along said tie bar.

6. The combination set forth in claim 4 wherein one of said bumper and the trailing end of said carrier is curved about a vertical axis.

7. In a conveyor system, the combination comprising
a conveyor track,
a conveyor movable along said track,
a free track,
a plurality of carriers movable along the free track,
said conveyor having longitudinally spaced pusher and holdback dogs mounted thereon,
each said carrier comprising spaced apart trolleys and means interconnecting said trolleys,
a trailing trolley having a pusher movably mounted thereon for movement into and out of the path of the pusher and holdback dogs,
a bumper,
said bumper being mounted on the leading trolley of said carrier and that engage a preceding carrier or an obstacle,
and means interconnecting said bumper and said retractable pusher and operating upon engagement of the bumper with the preceding carrier or obstacle to displace said bumper and thereby move said pusher out of the path of said pusher and holdback dogs, said means interconnecting said trolleys comprising a tie bar, said means interconnecting said bumper and said pusher including means extending along said tie bar, said tie bar being hollow, said means interconnecting said bumper and said pusher including a rod on which said bumper is connected extending through said tie bar, a cam plate pivoted on said rear trolley and engaged by said rod, and flexible cable means interconnecting said cam plate and said pusher.

8. The combination set forth in claim 7 including spring means yieldingly urging said rod forwardly.

9. The combination set forth in claim 7 wherein said cam plate is pivoted about a horizontal axis and extends downwardly.

10. The combination set forth in claim 7 wherein said cam plate is pivoted about a horizontal axis and normally extends upwardly.

11. In a conveyor system, the combination comprising a conveyor track, a conveyor movable along said track, a free track, a plurality of carriers movable along the free track, said conveyor having longitudinally spaced pusher and holdback dogs mounted thereon, each said carrier comprising spaced apart trolleys and means interconnecting said trolleys, a trailing trolley having a pusher movably mounted thereon for movement into and out of the path of the pusher and holdback dogs, a bumper, said bumper being mounted on the leading trolley of said carrier and that engage a preceding carrier or an obstacle, and means interconnecting said bumper and said retractable pusher and operating upon engagement of the bumper with the preceding carrier or obstacle to displace said bumper and thereby move said pusher out of the path of said pusher and holdback dogs, said means interconnecting said trolleys comprising a tie bar, said means interconnecting said bumper and said pusher including means extending along said tie bar, said means interconnecting said bumper and said pusher comprising a first rod telescoped within said tie bar and having a bumper mounted on the front end thereof and a second rod supported by said trailing trolley and associated with the pusher, a cam plate pivoted to said trailing trolley which transmit movement of the first rod to the second rod.

12. In a conveyor system, the combination comprising a conveyor track, a conveyor movable along said track, a free track, a plurality of carriers movable along the free track, said conveyor having longitudinally spaced pusher and holdback dogs mounted thereon and pivoted about horizontal longitudinally extending axes, each said carrier comprising spaced apart trolleys and means interconnecting said trolleys, a trailing trolley, a pusher, means for movably mounting said pusher on said trolley vertical for movement into and out of the path of the pusher and holdback dogs, a bumper, said bumper being mounted on a leading trolley of said carrier at the front end thereof and that engage a preceding carrier or an obstacle, and means interconnecting said bumper and said retractable pusher and operating upon engagement of the bumper with the preceding carrier or obstacle to displace said bumper and thereby move said pusher out of the path of said pusher and holdback dogs, said means interconnecting said trolleys comprising a tie bar pivoted about vertical axes to said trolleys, said means interconnecting said bumper and said pusher including means extending along said tie bar, said tie bar being hollow, said means interconnecting said bumper and said pusher including a rod on which said bumper is connected extending through said tie bar, a cam plate pivoted on said rear trolley and engaged by said rod, and flexible cable means interconnecting said cam plate and said pusher.

13. The combination set forth in claim 12 including spring means yieldingly urging said rod forwardly.

14. The combination set forth in claim 12 wherein said cam plate is pivoted about a horizontal axis and extends downwardly.

15. The combination set forth in claim 12 wherein said cam plate is pivoted about a horizontal axis and normally extends upwardly.

16. In a conveyor system, the combination comprising a conveyor track, a conveyor movable along said track, a free track, a plurality of carriers movable along the free track, said conveyor having longitudinally spaced pusher and holdback dogs mounted thereon and pivoted about horizontal longitudinally extending axes, each said carrier comprising spaced apart trolleys and means interconnecting said trolleys, a trailing trolley, a pusher, means for movably mounting said pusher on said trolley vertical for movement into and out of the path of the pusher and holdback dogs, a bumper, said bumper being mounted on a leading trolley of said carrier at the front end thereof and that engage a preceding carrier or an obstacle, and means interconnecting said bumper and said retractable pusher and operating upon engagement of the bumper with the preceding carrier or obstacle to displace said bumper and thereby move said pusher out of the path of said pusher and holdback dogs, said means interconnecting said trolleys comprising a tie bar pivoted about vertical axes to said trolleys, said means interconnecting said bumper and said pusher including means extending along said tie bar, said means interconnecting said bumper and said pusher comprising a first rod telescoped within said tie bar and having a bumper mounted on the front end thereof and a second rod supported by said trailing trolley and associated with the pusher, a cam plate pivoted to said trailing trolley which transmit movement of the first rod to the second rod.

* * * * *